United States Patent [19]

Nishimura et al.

[11] 4,168,119

[45] Sep. 18, 1979

[54] ELECTROPHOTOGRAPHIC COPYING APPARATUS UTILIZING LIQUID DEVELOPER

[75] Inventors: Matsuomi Nishimura, Tokyo; Shinkichi Takahashi, Yokohama; Kouichi Tanikawa, Kawasaki; Ikuo Souma, Yokohama; Nobuyuki Miyake; Hirokazu Negishi, both of Kawasaki, all of Japan

[73] Assignee: Canon Kabushiki Kaisha, Tokyo, Japan

[21] Appl. No.: 913,224

[22] Filed: Jun. 6, 1978

Related U.S. Application Data

[63] Continuation of Ser. No. 641,266, Dec. 16, 1975, abandoned.

[30] Foreign Application Priority Data

Dec. 27, 1974 [JP] Japan ..... 49-4012

[51] Int. Cl.[2] ..... G03G 15/10; G03G 21/00

[52] U.S. Cl. ..... 355/10; 118/662; 355/15

[58] Field of Search ..... 355/3 R, 10, 15; 118/659, 662, DIG. 23, 660

[56] References Cited

U.S. PATENT DOCUMENTS

| | | | |
|---|---|---|---|
| 3,663,219 | 5/1972 | Takahashi | 355/10 X |
| 3,722,994 | 3/1973 | Tanaka et al. | 355/10 |
| 3,815,989 | 6/1974 | Davis et al. | 355/10 |
| 3,900,003 | 8/1975 | Sato et al. | 355/10 X |
| 3,957,016 | 5/1976 | Yamada et al. | 355/10 X |
| 3,972,611 | 8/1976 | Tanaka et al. | 355/10 |
| 3,981,576 | 9/1976 | Inoue | 355/10 X |
| 4,033,687 | 7/1977 | Hirayama et al. | 355/3 R X |

FOREIGN PATENT DOCUMENTS

| | | | |
|---|---|---|---|
| 2233628 | 2/1973 | Fed. Rep. of Germany | 355/10 |

*Primary Examiner*—Fred L. Braun

*Attorney, Agent, or Firm*—Fitzpatrick, Cella, Harper & Scinto

[57] ABSTRACT

Electrophotographic copying apparatus of this invention includes an electrophotographic photosensitive member, elements for forming an electrostatic latent image on the photosensitive member, and for liquid developing the latent image, and elements for removing an excess liquid developer after the development and for applying thereafter substantially uniformly an electric field on the surface of the photosensitive member with the aid, for example, of a corona discharger or an electrode. The developed image is then transferred onto a transfer material and the photosensitive member is cleaned after the transfer, wherein each of these last two functions may be accomplished by conventional elements.

3 Claims, 1 Drawing Figure

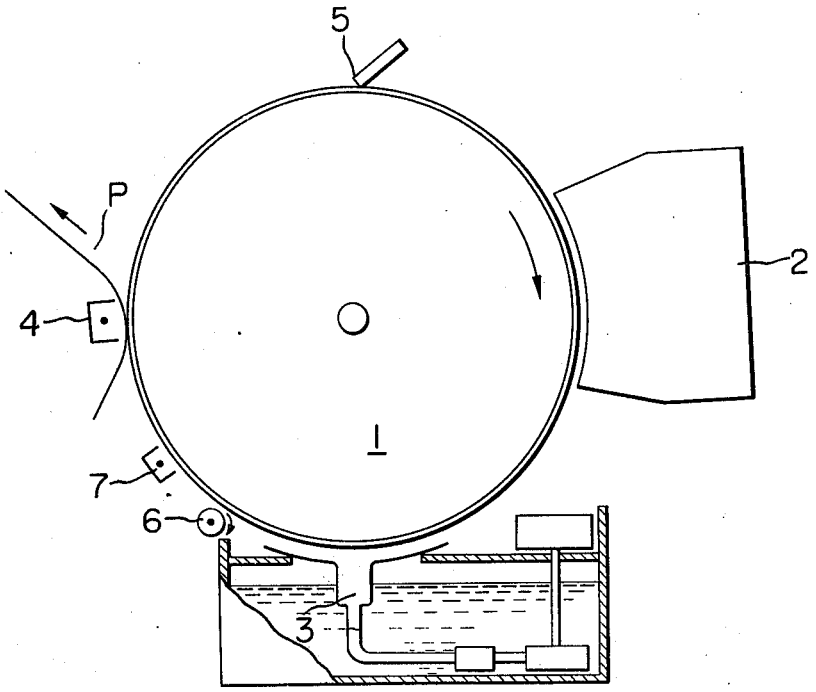
5
P
2
4
1
7
6
3

ELECTROPHOTOGRAPHIC COPYING APPARATUS UTILIZING LIQUID DEVELOPER

This is a continuation of application Ser. No. 641,266, filed Dec. 16, 1975, now abandoned.

BACKGROUND OF THE INVENTION

1. Field of the Invention

This invention relates generally to an electrophotographic copying apparatus and more particularly to an electrophotographic apparatus of the liquid developing and transfer type.

2. Description of the Prior Art

In a conventional electrophotographic copying apparatus, a drum type photosensitive member is rotated and charged and then exposed to a light image to form an electrostatic latent image, and the thus formed latent image is developed and the excess liquid developer on the photosensitive member is removed. Thereafter the developed image is transferred onto a transfer material and the transferred image is fixed.

Various kinds of apparatus have been known for removing the excess liquid developer. Such apparatuses are, for example, corona squeezing types using corona discharge as shown in U.S. Pat. No. 3,722,994, contact roller squeezing types using a roller in press-contact with the photosensitive member, air-knife squeezing types using air directed toward the photosensitive member, blade squeezing types using a blade disposed in the close vicinity of the photosensitive member, and rotating roller squeezing types using a roller disposed and rotating in the close vicinity of the photosensitive member.

However, when the excess liquid developer is removed by the above described apparatuses, except for corona discharge squeezing type, even if the excess liquid developer is removed sufficiently and there is no disturbance of the developed image on the photosensitive member, an insulating carrier liquid still remains among the toner particles forming the liquid developer so that the developed image will be disturbed when the image is transferred, consequently, the transferred image has defects in which, for example, fine lines become blurred, net points become broken, black areas or thick lines are disturbed and transfer is deteriorated, which would result in unclear and non-uniform transferred image.

On the other hand, if the carrier liquid attached among the toner particles of the liquid developer is completely removed, the transfer operation can not be performed smoothly which results in a deteriorated transfer.

Therefore it has been known that for obtaining a good transferred image it is necessary to retain a suitable amount of the liquid developer after the liquid developer has been squeezed.

SUMMARY OF THE INVENTION

The principal object of this invention is to remove said defects in case of using excess liquid developer removing apparatuses other than said corona discharge squeezing apparatus so as to present an improved electrophotographic copying apparatus capable of providing a clear uniform transferred image.

The other object of this invention is to present an improved electrophotographic copying apparatus in which a substantially uniform charge is applied to the surface of the photosensitive member after the excess amount of liquid developer has been removed so that the toner image is fixed and the flow of the toner image at the transfer step is prevented. Another object of this invention is to present an improved electrophotographic copying apparatus in which the charge of a polarity the same as the toner is substantially uniformly applied to the surface of the photosensitive member and the toner itself so that substantially uniform strengthened electric field is obtained at the transfer step.

For performing said objects, according to this invention, after the excess liquid developer is removed the charge is substantially uniformly applied to the surface of the developed latent image forming member.

BRIEF DESCRIPTION OF THE DRAWING

The drawing shows a structure of the embodiment according to the invention.

DESCRIPTION OF THE PREFERRED EMBODIMENT

This invention will be explained in detail referring to the accompanying drawing. The electrophotographic copying apparatus shown in the drawing has a conventional latent image forming means 2 to form an electrostatic latent image on the surface of the rotating drum type electrophotographic photosensitive member 1, a developer 3 to develop the latent image, a corona discharger for the station transfer 4 to transfer the developed image onto a transfer material P, and a cleaning means 5 for cleaning the surface of the photosensitive member for repetitive use. In this invention, liquid developer is used in the developing means 3. On the surface of the photosensitive member developed by liquid developer, when an excess of such liquid is present at the transfer step, a liquid flow is formed by the compression of a transfer material on the photosensitive member so that the toner image becomes disturbed. Consequently, it is necessary to provide means to remove the excess amount of liquid developer on the photosensitive member. In the drawing, a liquid developer squeezing roller 6 is provided in the close vicinity of the surface of the photosensitive member to rotate in the arrow direction which is opposite to the direction of the rotation of the photosensitive member. The roller 6 plays a role for removing the excess liquid developer. Corona discharger 7 is provided after the roller but before the transfer step to apply a corona discharge of a polarity which is the same as the polarity of the toner to impart the charge uniformly on the image surface of the photosensitive member after the image is developed. By giving such uniform charge of the same polarity as the toner, as for example by applying a corona discharge to the developed surface of the photosensitive member, due to the electrostatic attracting force between the given charge and the charge having the opposite polarity induced by the grounded conductive base of the photosensitive member and furthermore due to the electrostatic repulsing force between the charge given to the surface of the photosensitive member and the toner particles, the aggregate of the toner particles is pushed to the surface of the photosensitive member so that the contacts between the toner particles becomes closer and so that the toner image becomes clearer. This result is called a fix-effect. By this fix-effect, at the transfer step, no flow of the developed image occurs so that a clear, uniform tightened image is transferred onto the transfer material. By applying corona discharge on the developed surface of the photosensitive member, another effect of the uniform and strengthened electric field is provided at the transfer step due to the fact that the charge having the same polarity as of the toner is given to the surface of the photosensitive member as well as toner particles. In other words, the effect of enforcing the transfer electric field is produced.

As a result, at the transfer step, when the toner particles move toward the transfer material by the electrostatic attracting force produced by the transfer corona charge etc., the velocity of the toner in the direction perpendicular to the surface of the photosensitive member is increased and the movement of the toner particles in the direction parallel to the surface of the photosensitive member is decreased. Thus a sharp and uniform transfer image is obtained. Furthermore, the quantity of the toner particles actually transferred is increased and the transfer efficiency is improved.

Consequently, after the excess liquid developer is removed from the surface of the photosensitive member by the conventional excess liquid developer removing means other than corona discharge squeezing means, the charge having the same polarity as the toner is given to the developed surface of the photosensitive member, and the fix-effect and strengthening effect of the transfer electric field are produced to perform the objects of this invention.

The preferred examples of this invention are as follow.

EXAMPLE 1

A roller 6, having a 15 mm diameter as shown in the drawing, is disposed relative to the surface of the photosensitive member with an air space of 0.2 mm, and the roller 6 is rotated at a speed of 80 r.p.m. to remove the excess liquid developer. The thickness of the remaining liquid developer is 8$\mu$. Thereafter by means of the corona discharger 7, the corona discharge (−6.4 KV) having the same polarity as of the toner is applied to the developed image before the transfer step. The transferred image thus obtained is clearer in comparison to a transferred image obtained without using said corona discharge.

EXAMPLE 2

The rotational speed of the roller in Example 1 is increased to 150 r.p.m. The thickness of the remaining liquid developer becomes 3$\mu$ and the similar result in clearness is obtained as compared to Example 1. Thus, it is confirmed that the application of the charge on the surface of the photosensitive member using the corona discharger 7 is effective to give sharpness and uniformity to the transferred image.

In the foregoing explanation, the charge to be applied to the surface of the photosensitive member after the removal of the excess liquid developer is of a polarity the same as of the toner to obtain a good result, however, if the transfer condition is suitably selected, the polarity opposite to the polarity of the toner is also effective, however, in the latter case, since the fix-effect is not sufficient, the sharp and uniform transfer image of the former case is not expected. In the latter case, however, sharpness and uniformity are improved as compared to the case where no charge is applied.

Moreover, the application of A.C. corona discharge also gives a sharp and uniform transfer image as in case of the application of a charge of the same polarity as that of the toner.

Instead of applying the charge uniformly on the surface of the photosensitive member after the removal of the excess liquid developer, an electrode may be provided close to and parallel with the surface of the photosensitive member, and a high voltage is then applied to the electrode. Thus the strong electric field is obtained and produces the same effect as of the fix-effect. However, in this case, if the electric field is removed the fix-effect is diminished and the transfer electric field strengthening effect is not expected at the transfer step.

Furthermore, it is also possible to apply the present invention to a system using corona discharge squeezing means for removing the excess liquid developer. In this case it is preferable to use the corona discharge of the same polarity as that of the toner but the discharge of the opposite polarity can also be used. During the step of corona discharge squeezing, said fix-effect and the effect of the transfer electric field are obtained. However, since the amount of the corona charge in said corona discharge squeezing must then be high, the fatigue characteristics of the photosensitive member are badly effected and the useful life of the photosensitive member becomes short. Such fatigue problems can be avoided, however, by applying a charge to the photosensitive member, after removing the excess liquid developer, of a polarity opposite to the corona derived from the corona discharge squeezing and by these means a sharp and uniform transfer image is obtained.

It is noted that this invention is applied to the electrophotographic process not including the transfer step and a sharp and uniform transfer image is obtained by the fix-effect of the charge.

What is claimed is:

1. Electrographic transfer-type copying apparatus comprising:

an electrographic photosensitive member;

means for forming an electrostatic latent image on the photosensitive member;

means for developing the electrostatic latent image using a liquid developer including charged toner particles applied to the latent image on the photosensitive member;

means including a first corona discharger for applying a discharge to said photosensitive member to remove excess liquid developer from the image on the photosensitive member after developing to reduce the amount of liquid on the image to a level suitable for transfer;

means including a second corona discharger for applying a discharge for forming substantially uniformly an electric field on the surface of the photosensitive member bearing the developed image, to provide a controlled surface potential on said member after the excess liquid developer has been removed and before transfer of the image, wherein said first and second corona dischargers have opposite discharge polarities;

means for transferring the developed image onto a transfer material; and means for cleaning the photosensitive member after transferring the image.

2. Electrographic transfer-type copying apparatus according to claim 1, in which said first corona discharger applies corona discharge of the same polarity as the toner particles.

3. Electrographic transfer-type copying apparatus according to claim 1, in which said second corona discharger applies an AC corona discharge.

* * * * *